United States Patent [19]

Sargent

[11] 4,355,802

[45] Oct. 26, 1982

[54] BILLIARD TABLE

[75] Inventor: Alfred E. Sargent, Hardin, Mont.

[73] Assignee: Montana Billiard Supply, Billings, Mont.

[21] Appl. No.: 244,768

[22] Filed: Mar. 17, 1981

Related U.S. Application Data

[63] Continuation-in-part of Ser. No. 38,675, May 14, 1979, abandoned.

[51] Int. Cl.[3] ..... A63D 15/20

[52] U.S. Cl. ..... 273/11 R; 273/122 A; 273/123 A; 273/125 A

[58] Field of Search ..... 235/92 GA; 273/1 E, 273/11 R, 11 C, 12, 14, 57 C, 118 A, 119 A, 120 A, 121 A, 122 A, 123 A, 124 A, 125 A, 127 C, 138 A; 340/323 R

[56] References Cited

U.S. PATENT DOCUMENTS

| | | | |
|---|---|---|---|
| 1,146,242 | 7/1915 | Garaughty | 273/14 |
| 1,163,412 | 12/1915 | Jorstad | 273/14 |
| 2,825,565 | 3/1958 | Hooker | 273/11 R |
| 3,439,281 | 4/1969 | McGuire et al. | 273/138 A |
| 3,488,054 | 1/1970 | Brzoska | 273/11 R |
| 3,770,269 | 11/1973 | Elder | 273/138 A |
| 3,918,716 | 11/1975 | Nonaka et al. | 273/138 A |
| 4,030,555 | 6/1977 | Boyce et al. | 273/121 A |

*Primary Examiner*—Vance Y. Hum

*Attorney, Agent, or Firm*—Arthur L. Urban

[57] ABSTRACT

A billiard table having a playing surface, a plurality of pockets associated with the playing surface, ball collecting mechanism below the playing surface for transferring balls entering the pockets into a common channel, circuitry including an electrical power source, ball contacting switch mechanism disposed along the common channel, a first pulse counter responsive to pulses from the switch, an oscillator, a second pulse counter responsive to pulses from the oscillator, a latch associated with and responsive to the second pulse counter, a digital comparator receiving signals from the first pulse counter and from the latch of the second pulse counter, a decoder transmitting a pulse from the comparator and display mechanism capable of receiving the pulses from the decoder; whereby rapid periodic pulses transmitted from the oscillator to the second pulse counter cause signals to be sent to the latch at the same rate, so that when a ball passes the switch mechanism, a pulse is transmitted from the switch mechanism to the latch to lock the signal transmitted to the comparator, and at the same time a pulse is transmitted from the switch mechanism to the first pulse counter causing a signal to be transmitted to the comparator, and when the signal from the first pulse counter matches the signal from the latch, a pulse is transmitted from the comparator through the decoder to the display and the free game mechanism.

9 Claims, 4 Drawing Figures

FIG. 1
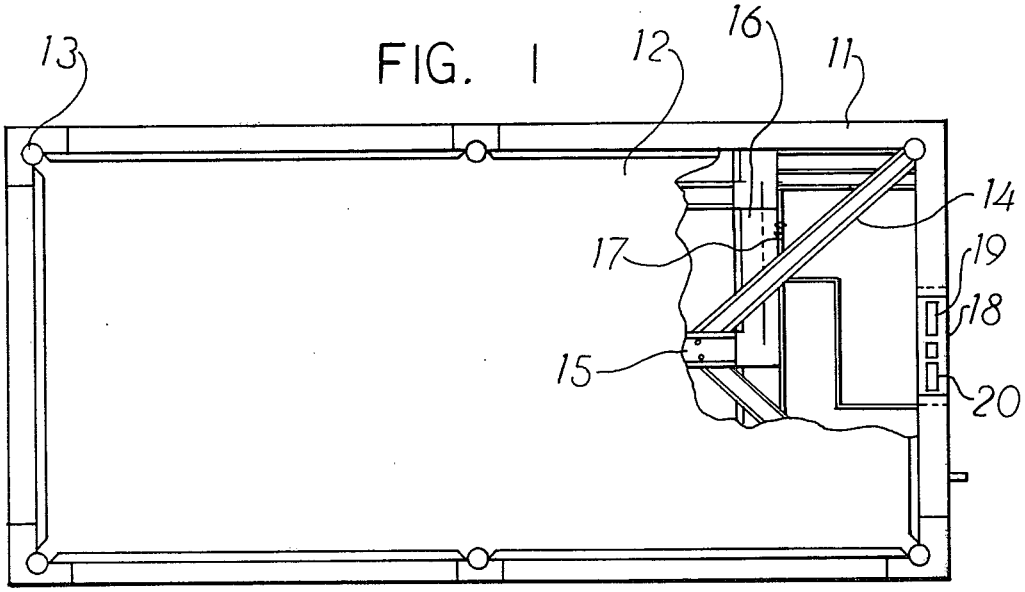
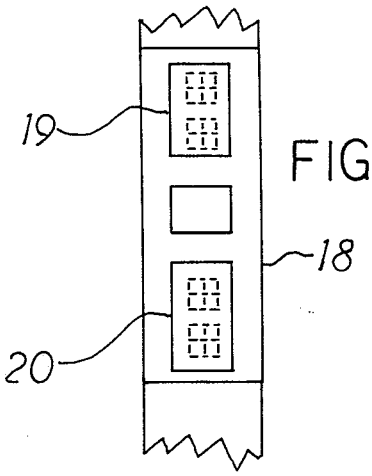
FIG. 2
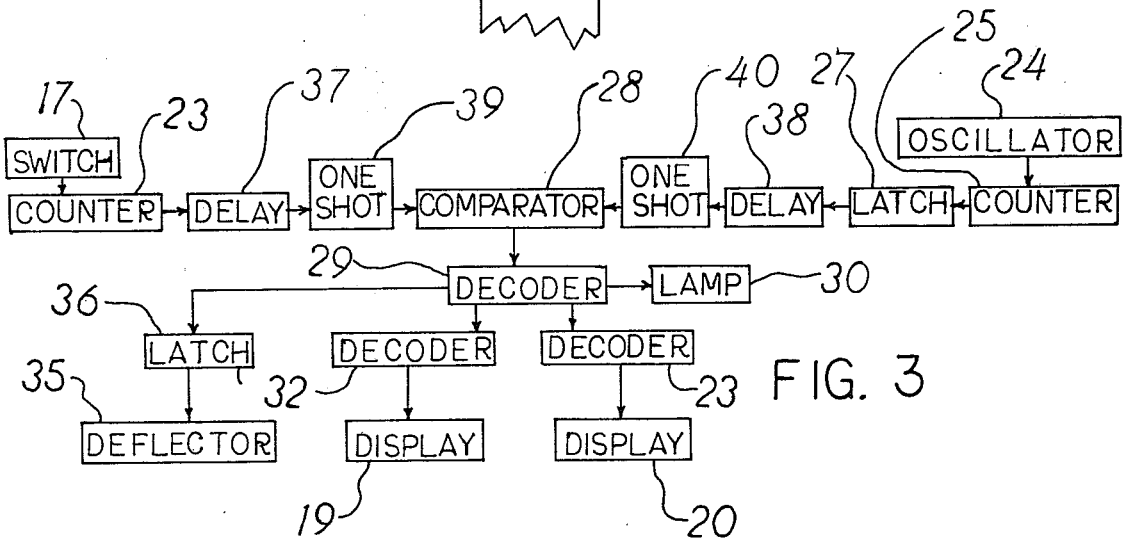
FIG. 3

BILLIARD TABLE

This application is a continuation-in-part of pending application Ser. No. 38,675, filed May 14, 1979, now abandoned.

This invention relates to a novel billiard table and more particularly relates to a new pocket billiard table for commercial establishments.

In recent years there has been a major increase in the popularity of pocket billiards. This revival has been both in the home and especially in billiard lounges and other commercial establishments. Commercial billiard tables not only have to be sturdily constructed to take heavy use and abuse normally encountered in such use, but also the tables advantageously incorporate features to accommodate the different playing conditions of commercial establishments.

Most of the new features incorporated into commercial pocket billiard tables are for the benefit of the table owner rather than the player. For example, tables are coin operated to reduce the supervision by the proprietor. Ball retention and cue ball separation are other features which help reduce table supervision by the proprietor or members of his staff since they prevent extra play without paying. However, little if any, of the features now being adopted provide any benefit for the player.

Some of the features, in fact, actually may have a negative effect on play. For example, many of the cue ball separators rely on changes in the cut ball such as differences in size or incorporation of magnets or other foreign substances which can be detected. These changes in the cue ball can effect play in several ways—by actually altering ball performance or by creating a psychological block in the player's mind so he does not perform up to his potential.

One feature which appeals to most game players in commercial establishments is a free game. The opportunity to win a free game is available in most coin operated games such as pinball and slot machines. However, few commercial billiard tables offer a chance at a free game, and even with those tables that do, most of them require extra attention on the part of the proprietor or his staff to be sure that there is no cheating.

The new features generally being incorporated into commercial billiard tables are usually for the purpose of reducing supervision time on the part of the proprietor or members of his staff. In contrast, the free game feature may be considered to be inconsistent with this objective. As a result, there is little acceptance by proprietors of presently offered billiard tables that incorporate a free game feature. It is believed, however, that proprietors would welcome a billiard table which includes a free game feature that does not increase the amount of time and effort they must devote to the supervision and control of tables with this feature.

The present invention provides a novel commercial billiard table with a free game feature. The billiard table of the invention provides a free game feature that does not require supervision by the proprietor to avoid cheating. Furthermore, the free game operating mechanism of the billiard table of the invention operates automatically without involvement by the proprietor or members of his staff.

Another advantage of the free game feature of the billiard table of the invention is that the table provides a special attraction for players so that there will be increased play on the table. The increased play on the table results in increased profits derived from the table of the invention without additional time and effort on the part of the proprietor.

Furthermore, the free game mechanism of the billiard table functions automatically so that it is convenient for participants even if they are inexperienced players. The free game is displayed prominently for easy recognition by the players. In addition, the players are afforded ready access to the balls for the free game.

Moreover, all players, regardless of the level of their skill, have an equal opportunity to win a free game with the billiard table of the invention. Thus, not only skilled players, but all players have a high degree of interest in the free game feature. In fact, the free game feature may have more appeal for mediocre players since it gives them a sense of satisfaction even if their play is not up to expectations.

The free game mechanism of the billiard table of the invention also is convenient to install and set up. Further, the free game mechanism has a high degree of reliability and requires little if any service or maintenance. In addition, the operation of the free game mechanism can be coordinated with other operating mechanisms of the table easily. Also, the operation of the free game mechanism can be adjusted to change the procedure for winning and/or the proportion of winners simply and conveniently. Moreover, the free game mechanism can be fabricated from commercially available components.

Other benefits and advantages of the novel billiard table of the present invention will be apparent from the following description and the accompanying drawings in which:

FIG. 1 is a top view of one form of the novel pocket billiard table of the invention partially in section;

FIG. 2 is an enlarged top view of the free game portion of the billiard table shown in FIG. 1;

FIG. 3 is a block diagram of circuitry for the free game portion;

Figure 4:
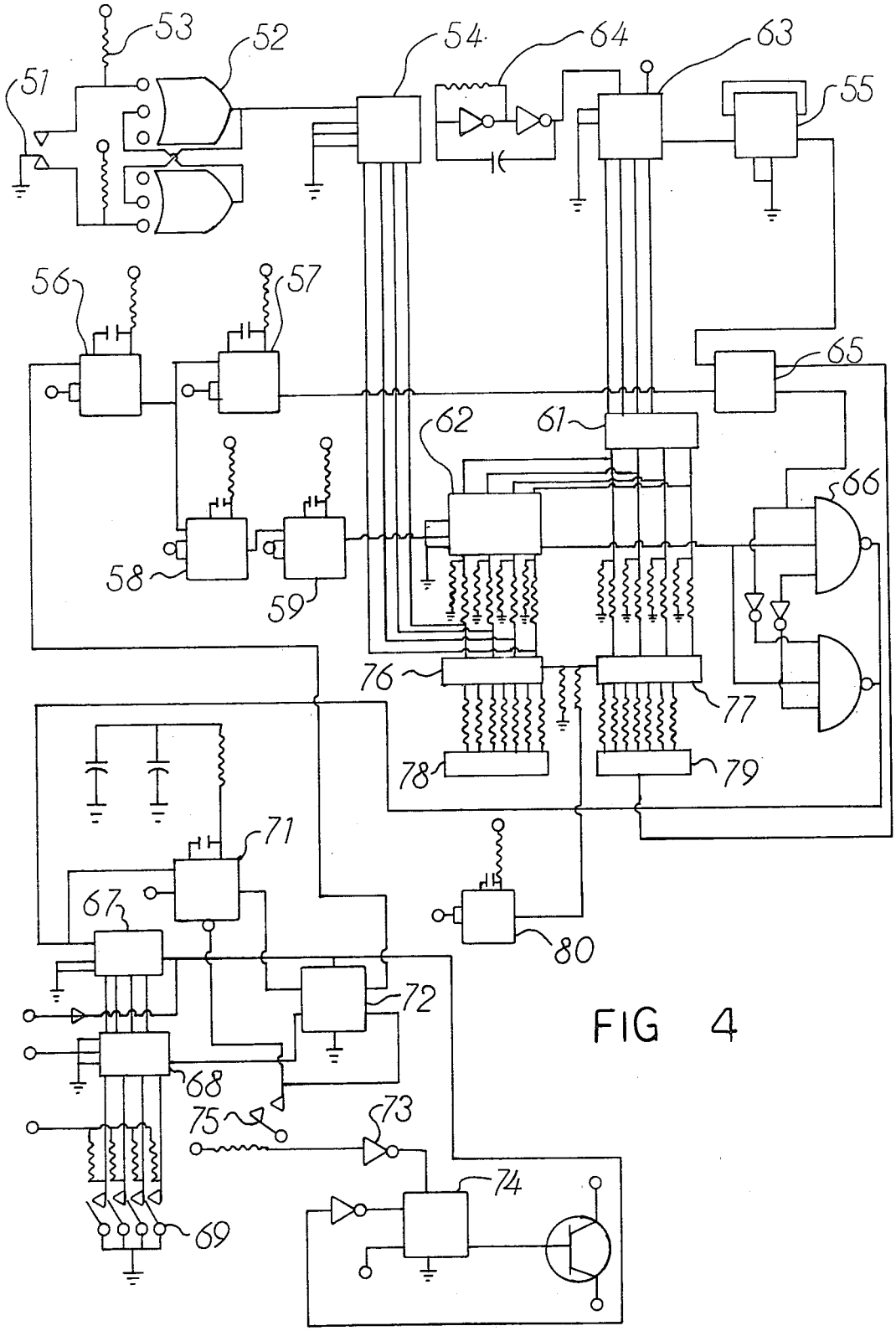
FIG. 4 is a detailed diagram of one form of circuitry for the free game portion of the billiard table of the invention.

As shown in the drawings, one form of the novel pocket billiard table of the present invention includes a frame 11 with a playing surface 12. A plurality of pockets 13 are located at the corners of the playing surface 12 and at the midpoint of the longer sides of the table. Ball collecting means shown as tracks 14 and 15 are located below the playing surface. The tracks 14 are positioned to transfer balls entering the pockets 13 onto a central track 15 and then to a common channel 16.

The free game mechanism of the billiard table of the invention includes a ball contacting switch 17 disposed along channel 16. Switch 17 is connected through appropriate circuitry to a display panel 18. Display panel 18 as shown in greater detail in FIG. 2 has two display windows 19 and 20. One of the windows indicates the number of balls that have entered the pockets and passed switch 17. The other window displays a random number which is selected by the circuitry of the mechanism as each ball contacts switch 17.

The circuitry of the free game mechanism of the billiard table of the invention is shown in the block diagram illustrated in FIG. 3 of the drawings. As shown, the circuitry includes an electrical power source which preferably is a battery 22. A first pulse counting means 23 is responsive to pulses from ball contacting switch 17. An oscillating means 24 is provided to generate pulses for a second pulse counting means 25. Latching means 27 is associated with the second pulse counting means 25. The latching means 27 is responsive to pulses from the ball contacting switch 17. A digital comparing means 28 also receives pulses from switch 17 and in addition receives signals from the first pulse counting means 23 and from latching means 27 that is associated with the second pulse counting means 25.

Advantageously, the circuitry also includes decoding means 29 which transmits a pulse from the comparing means 28 to a suitable indicator such as lamp 30 to show that a free game has been won. The circuitry may include additional decoding means 32 and 33 associated with the display windows 19 and 20. Preferably, the circuitry includes a memory circuit responsive to pulses from decoding means 29. The memory circuit includes means for activating ball supply means such as tiltable ball storage tray 34 with its electrical deflecting means 35. A preferred memory circuit includes latching means 36 associated with the deflecting means 35.

The free game circuitry of the billiard table of the invention advantageously includes delay means 37 and 38 and one shot means 39 and 40. Delay means 37 and one shot means 39 combine to coordinate the transmission of signals from first pulse counting means 23 to comparing means 28. Likewise, delay means 38 and one shot means 40 combine to coordinate the transmission of signals from latching means 27 of second pulse counting means 25 to comparing means 28. In addition, the combination of delay means 38 and one shot means 40 energizes comparing means 28.

One form of circuitry for the free game mechanism of the billiard table of the invention is illustrated in greater detail in FIG. 4. As shown, a ball contacting switch 51 is connected to a gate 52 that is energized by a battery controlled source 53. Gate 52 conditions the pulses from switch 51 and transmits them to a first counter 54. Also, gate 52 transmits pulses to delay 56.

Delay 56 in combination with one shot 57 and a second delay 58 and one shot 59 coordinates the transmission of signals from first counter 54 and from a latch 61 to a digital comparator 62. Also, the combination of the delays and one shots energizes the comparator 62.

Latch 61 receives signals from a unit number pulse counter 63 which in turn receives pulses from an oscillator 64. If comparator 62 receives matching signals from first counter 54 and latch 61, it transmits a pulse to gate 66 which transmits a pulse indicating a match. Similarly, signals from unit number counter are transmitted to ten number counters 55 and 65.

To provide a means for modifying the procedure for winning a free game, the circuitry includes a third counter 67 which transmits signals to a second comparator 68. As shown, this may be accomplished through a series of switches 69 that may be selectively changed to modify the proportion of winners.

A memory circuit advantageously is provided to control the release of the balls for the free game at the appropriate time. The memory circuit may include a clock 71, a flip flop 72, an inverter 73 and a latch 74. Latch 74 controls the operation of transistor which activates the mechanism (not shown) that releases the balls.

A visual display of the two numbers utilized in establishing the match is present on display panel 18. To achieve this effect, signals from first counter 54 and from latch 61 of unit number counter 63 are transmitted to appropriate decoders 76 and 77, respectively. The decoders in turn activate displays 78 and 79, respectively so that the numbers may be observed in display windows 19 and 20. Likewise, ten number counter 65 also activates display 79 to indicate the second digit of the display. A one shot 80 is associated with displays 78 and 79 to activate same for a few seconds at the start of play as a check on the functioning thereof.

In the operation of the free game mechanism of the billiard table of the present invention, ball contacting switch 17 is actuated as each of the balls other than the cue ball passes. By locating the switch 17 after the cue ball has been separated, only the balls being played will be recorded as they leave the playing surface. Each pulse from switch 17 is recorded by first counter 54 and displayed on panel 18.

During play, oscillator 64 is transmitting periodic pulses to unit number counter 63 at a rapid rate. Counter 63 sends signals to latch 61 at the same rate and also sends signals to ten number counters 55 and 65. When a ball passes switch 17, the switch also transmits a pulse to latch locking in a signal that is transmitted to comparator 62. The transmission of the signal from latch 61 is coordinated with the reception of signals from first counter 54 by delays 56 and 58 and one shots 57 and 59.

If the number of balls passing switch 17 is the same as the random number present in latch 61 as a ball passes the switch, comparator 62 will transmit a pulse to third counter 67. Signals from third counter 67 will enter second comparator 68 which also is receiving appropriate modifying signals from switches 69. Should the signals match, a pulse will be transmitted to the memory circuit that includes latch 74. When a player wishes to obtain the balls for his free game, he depresses push button 75 so that latch 74 will activate the ball release mechanism (not shown). A visual display of the signals from first counter 54 and latch 61 is presented on display panel 18 through decoders 76 and 77 and displays 78 and 79. Advantageously, the displays are of the LED type.

The above description and the accompanying drawings show that the present invention provides a novel billiard table with free game opportunity. The free game feature does not require involvement by the proprietor or members of his staff but instead operates automatically. Furthermore, the free game mechanism of the billiard table of the invention is convenient to install and set up. Also, the free game mechanism can be coordinated in its operation with other mechanisms of the table. In addition, the operation of the free game mechanism can be adjusted to change the procedure for winning and/or the chances of winning simply and conveniently, if desired.

It will be apparent that various modifications can be made in the particular billiard table and free game mechanism described in detail above and shown in the drawings within the scope of the invention. For example, elements of the circuitry can be combined into integrated circuit chips or microprocessor units. Also, other components can be substituted provided they do not adversely affect the functioning of the mechanism. In addition, the size and configuration of certain components can be different to meet specific requirements. Therefore, the scope of the invention is to be limited only by the following claims.

What is claimed is:

1. A billiard table having a playing surface, a plurality of pockets associated with said playing surface, ball collecting means below said playing surface for transferring balls entering said pockets into a common channel, circuitry including an electrical power source, ball contacting switch means disposed along said common channel, first pulse counting means responsive to pulses from said switch, oscillating means, second pulse counting means responsive to pulses from said oscillating means, latching means associated with said second pulse counting means and responsive to pulses therefrom, digital comparing means receiving signals from said first pulse counting means and from said latching means of said second pulse counting means, decoding means transmitting a pulse from said comparing means and display means capable of receiving said pulses from said decoding means; whereby rapid periodic pulses transmitted from said oscillating means to said second pulse counting means cause signals to be sent therefrom to said latching means at the same rate, so that when a ball passes said switch means, a pulse is transmitted from said switch means to said latching means to lock the signal transmitted to said comparing means, and at the same time a pulse is transmitted from said switch means to said first pulse counting means causing a signal to be transmitted therefrom to said comparing means, and when said signal from said first pulse counting means matches said signal from said latching means, a pulse is transmitted from said comparing means through said decoding means to said display means.

2. A billiard table according to claim 1 wherein said circuitry includes a memory circuit responsive to pulses from said decoding means.

3. A billiard table according to claim 2 wherein said memory circuit includes means for activating ball supply means.

4. A billiard table according to claim 3 wherein said memory circuit includes latching means for activating said ball supply means.

5. A billiard table according to claim 1 wherein said circuitry includes delay means and one shot means.

6. A billiard table according to claim 5 wherein said delay means and said one shot means coordinate the transmission of signals from said first pulse counting means and from said latching means of said second pulse counting means to said digital pulse comparing means and energize said pulse comparing means.

7. A billiard table according to claim 6 wherein said circuitry includes a memory circuit responsive to pulses from said decoding means.

8. A billiard table according to claim 1 including decoding means and display means responsive to signals from said first pulse counting means and decoding means and display means responsive to signals from said latching means of said second pulse counting means.

9. A billiard table according to claim 1 wherein said circuitry includes a third pulse counting means, a second comparing means and means for modifying the output from said second comparing means.

* * * * *